US006807348B2

(12) United States Patent
Lu et al.

(10) Patent No.: US 6,807,348 B2
(45) Date of Patent: Oct. 19, 2004

(54) LIQUID METAL HEAT PIPE STRUCTURE FOR X-RAY TARGET

(75) Inventors: Qing K. Lu, Aurora, IL (US); Paul M. Xu, Oswego, IL (US); Norman E. Wandke, Naperville, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 166 days.

(21) Appl. No.: 10/097,498

(22) Filed: Mar. 14, 2002

(65) Prior Publication Data

US 2003/0174811 A1 Sep. 18, 2003

(51) Int. Cl.[7] ..... H01J 35/10

(52) U.S. Cl. ..... 385/125; 378/127; 378/130; 378/141

(58) Field of Search ..... 378/125, 127, 378/130, 141, 143, 144

(56) References Cited

U.S. PATENT DOCUMENTS

| | | | | |
|---|---|---|---|---|
| 4,165,472 A | * | 8/1979 | Wittry | 378/127 |
| 5,541,975 A | * | 7/1996 | Anderson et al. | 378/130 |
| 5,697,428 A | | 12/1997 | Akachi | 165/104.21 |
| 6,249,563 B1 | | 6/2001 | Snyder et al. | 378/19 |
| 6,252,937 B1 | | 6/2001 | Snyder | 378/141 |
| 6,263,046 B1 | | 7/2001 | Rogers | 378/141 |
| 6,304,631 B1 | * | 10/2001 | Snyder | 378/130 |
| 6,307,916 B1 | | 10/2001 | Rogers et al. | 378/141 |

FOREIGN PATENT DOCUMENTS

| | | |
|---|---|---|
| DE | 3220212 | 12/1983 |
| JP | 61259445 | 11/1986 |
| JP | 63315888 | 12/1988 |
| JP | 03156293 | 7/1991 |

OTHER PUBLICATIONS

Reid, et al., "Review of Liquid Metal Heat Pipe Work at Los Alamos"; Conf–910116, 1991 *American Institute of Physics,* pp. 999–1007.

Wittry, et al., "Novel "heat–pipe" rotating anode for x–ray lithography"; *J. Vac. Sci. Technology,* 16(6), Nov./Dec. 1979; 1980 American Vacuum Society; pp. 1946–1948.

* cited by examiner

*Primary Examiner*—Therese Barber

(57) ABSTRACT

An x-ray tube (10) includes an evacuated envelope (14), a cathode assembly (20) located in the evacuated envelope and a disk shaped anode assembly (18) located in the evacuated envelope in operative relationship with the cathode assembly for generating x-rays (40). The anode assembly includes an axis of rotation (26) and a target substrate (28) facing the cathode assembly. A heat pipe (33) is located within the anode assembly (18). The heat pipe is comprised of an evacuated shell (60) and is vacuum sealed at a first end (70) of the shell and at a second end (72). A material (80, 82) within the shell is a working fluid for the heat pipe at x-ray tube operating conditions. A porous wick (62) is located within the shell and the wick has a length extending from the first end (70) of the shell to the second end (72) of the shell. A shield (64) is attached to the wick to reduce working fluid loss out of the wick during x-ray tube operation.

20 Claims, 4 Drawing Sheets

LIQUID METAL HEAT PIPE STRUCTURE FOR X-RAY TARGET

BACKGROUND

The present invention relates to x-ray tube technology and is particularly related to a rotating anode x-ray tube having a liquid metal heat pipe apparatus that transfers heat from the region of a focal track of the anode and will be described with particular respect thereto.

Conventional diagnostic use of x-radiation includes the form of radiography, in which a still shadow image of the patient is produced on x-ray film, fluoroscopy, in which a visible real time shadow light image is produced by low intensity x-rays impinging on a fluorescent screen after passing through the patient, and computed tomography (CT) in which complete patient images are digitally constructed from x-rays produced by a high powered x-ray tube rotated about a patient's body.

Typically, an x-ray tube includes an evacuated envelope made of metal or glass which is supported within an x-ray tube housing. The x-ray tube housing provides electrical connections to the envelope and is filled with a fluid such as oil to aid in cooling components housed within the envelope. The envelope and the x-ray tube housing each include an x-ray transmissive window aligned with one another such that x-rays produced within the envelope may be directed to a patient or subject under examination. In order to produce x-rays, the envelope houses a cathode assembly and an anode assembly. The cathode assembly includes a cathode filament through which a heating current is passed. This current heats the filament sufficiently that a cloud of electrons is emitted, i.e. thermionic emission occurs. A high potential, on the order of 100–200 kV, is applied between the cathode assembly and the anode assembly.

This potential causes the electrons to flow from the cathode assembly to the anode assembly through the evacuated region in the interior of the evacuated envelope. A cathode focusing cup housing the cathode filament focuses the electrons onto a small area or focal spot on a target of anode assembly. The electron beam impinges the target with sufficient energy that x-rays are generated. A portion of the x-rays generated pass through the x-ray transmissive windows of the envelope and x-ray tube housing to a beam limiting device, or collimator, attached to the x-ray tube housing. The beam limiting device regulates the size and shape of the x-ray beam directed toward a patient or subject under examination thereby allowing images to be constructed.

In order to distribute the thermal loading created during the production of x-rays, a rotating anode assembly configuration has been adopted for many applications. In this configuration, the anode assembly is rotated about an axis such that the electron beam focused on a focal spot of the target impinges on a continuously rotating circular path, a focal track, about a peripheral edge of the target. Each portion along the circular path of the focal track becomes heated to a very high temperature during the generation of x-rays and is cooled as it is rotated before returning to be struck again by the electron beam. In many high powered x-ray tube applications such as CT, the generation of x-rays under operating and component design specifications often causes portions of the anode assembly to be heated to a temperature range of 1200–1800° C. Temperatures can reach 2500° C. at the focal spot in some x-ray tubes. As tube power requirements increase the diameter, mass and rotating velocity are increased. Larger anodes require (i) longer time to reach operational speed of the rotating anode, (ii) decreased x-ray tube and bearing life, (iii) added cost of manufacture and operation and (iv) additional system stresses when the rotating anode x-ray tube is rotated at higher speeds on Computed Tomography gantry systems.

Typically, the anode assembly is mounted to a rotor which is rotated by an induction motor. The anode assembly and rotor are part of a rotating assembly which is supported by a bearing assembly. The bearing assembly provides for a smooth rotation of the anode assembly about its axis with minimal frictional resistance. Bearings disposed in the bearing assembly often consist of a ring of metal balls which surround and rotatably support the rotor to which the anode assembly is mounted. Each of the balls are typically lubricated by application of lead or silver to its outer surface thereby providing support to the rotating assembly with minimal frictional resistance.

As the need for higher power x-ray tubes increases, larger anodes have increased moments of inertia and require more force from the induction motor to accelerate quickly to operational speeds. Some of the disadvantages listed above are interrelated, for example, slower acceleration of the anode induces more heat in the rotor of the x-ray tube. The rotor heat, in addition to the heat transferred from the anode during normal operation, can migrate to the bearings which can result in reduced lubricant efficiency due to evaporation of the lead and silver ball bearing lubricant. Reduced lubricant efficiency is detrimental to tube and bearing life.

As the anode accelerates to operational speed, it passes rotational speeds that create major mechanical resonances in the rotating components of the tube. Less efficient motors, having slower acceleration of the anode to operational speed, increases the amount of time that the anode experiences these major mechanical resonances. This factor also increases mechanical wear of the bearings and has an undesirable effect on tube and bearing life.

During operation in the field it is possible, or in a life critical situation necessary, for the x-ray technician to operate an x-ray tube at operating conditions that result in x-ray tube components experiencing temperatures that exceed operating and component design specifications. In addition to field operation, various processes during manufacture of the tube, such as exhausting and seasoning the tube, also subject an x-ray tube to high thermal loads. Exhausting the tube is the process in which vacuum is drawn in the tube. The tube is operated with internal components at high temperatures while a vacuum pump is operatively attached to the tube. The rate at which gas is removed from the tube and the resulting final pressure of the tube are related to the temperature of the components, such as the anode, during exhaust. The higher the temperature of the component the more effectively the gas is removed from the tube and the lower the pressure of the tube after exhaust.

Seasoning also produces considerable thermal loading for various x-ray tube components. Seasoning is the process in which the tube is exposed to progressively higher voltages and power. This "burn in" procedure assists in making the tube more electrically stable at high voltages experienced during tube operation. During the seasoning process the anode target focal track is exposed to some of the highest temperatures that it will experience. During seasoning, the focal track of the anode outgasses and evolves gas molecules into the vacuum envelope, thereby raising the gas pressure.

Damage to x-ray tubes due to thermal loading greater than operating and component design specifications can result in warranty claims and decreased product performance. Therefore, it is desirable to provide an x-ray tube that has a smaller anode with the desired capacity to provide the operating performance for more powerful x-ray applications.

SUMMARY OF THE INVENTION

The present invention is directed to an x-ray target that satisfies the need to provide a smaller sized anode with increased operating performance by more effective cooling of the focal track. An apparatus illustrating principles of present invention includes an x-ray tube comprising an evacuated envelope, a cathode assembly located in the evacuated envelope and an anode assembly located in the evacuated envelope in operative relationship with the cathode assembly for generating x-rays. The anode assembly includes, an axis of rotation, a target substrate facing the cathode assembly for generating the x-rays and a back plate located opposite the cathode assembly. At least one heat pipe is located within the anode assembly. The heat pipe comprises a longitudinal cylindrical evacuated shell having a generally central longitudinal axis. A first end of the shell is located in the target substrate and a second end is located in the back plate. A material within the shell is a working fluid for the heat pipe at x-ray tube operating conditions. A porous cylindrical wick within the shell generally extends along the longitudinal axis from the first end of the shell to the second end of the shell. A tubular void within the shell extends along the wick between the wick and shell. A shield attached to the wick along its length. The shield reduces working fluid loss out of the wick into the tubular void between the first and second end during x-ray tube operation.

Another apparatus illustrating principles of the present invention includes an x-ray tube comprising an evacuated envelope, a cathode assembly located in the evacuated envelope, a disk shaped anode assembly located in the evacuated envelope in operative relationship with the cathode assembly for generating x-rays. The anode assembly includes an axis of rotation and a target substrate facing the cathode assembly for generating the x-rays. A heat pipe is located within the anode assembly. The heat pipe comprises an evacuated shell having a first tubular wall and a second tubular wall concentrically spaced apart from one another and defining a void. Each of the first and second tubular walls have a central longitudinal axis that lies generally along the axis of rotation of the anode assembly. The tubular walls are vacuum sealed at a first end of the shell and at a second end of the shell. A material within the shell that is a working fluid for the heat pipe at x-ray tube operating conditions. A porous wick is located within the void of the shell. The wick has a height extending from the first end of the shell to the second end of the shell. A shield is attached to and extends along the height of the wick.

The present invention provides the foregoing and other features hereinafter described and particularly pointed out in the claims. The following description and accompanying drawings set forth certain illustrative embodiments of the invention. It is to be appreciated that different embodiments of the invention may take form in various components and arrangements of components. These described embodiments being indicative of but a few of the various ways in which the principles of the invention may be employed. The drawings are only for the purpose of illustrating a preferred embodiment and are not to be construed as limiting the invention.

BRIEF DESCRIPTION OF THE DRAWINGS

The foregoing and other features and advantages of the present invention will become apparent to those skilled in the art to which the present invention relates upon consideration of the following detailed description of a preferred embodiment of the invention with reference to the accompanying drawings, wherein.

DETAILED DESCRIPTION

Figure 1:
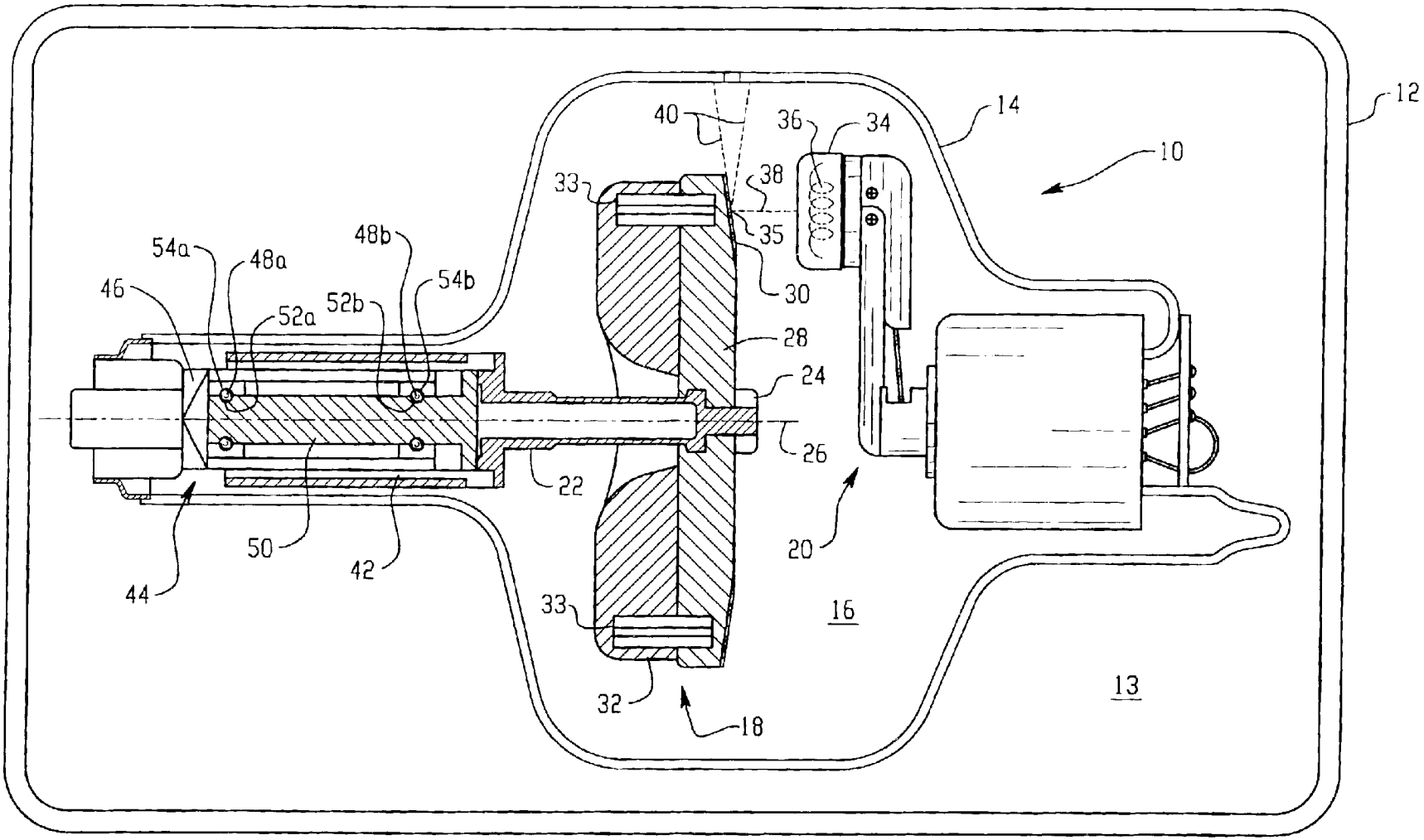
FIG. 1 is a partial cross sectional view of an x-ray tube showing aspects of the present invention.

With reference to FIG. 1, an x-ray tube 10 is mounted within an x-ray tube housing 12 filled with oil 13 or other suitable cooling fluid. The oil 13 is pumped through the x-ray tube housing 12 to absorb heat from the x-ray tube 10 and transfer such heat to a cooling system and heat exchanger (not shown) disposed outside the x-ray tube housing 12. The x-ray tube 10 includes an envelope 14 defining an evacuated chamber or vacuum 16. The envelope 14 is made of glass although other suitable materials including other ceramics or metals could also be used.

Disposed within the envelope 14 is an anode assembly 18 and a cathode assembly 20. The cathode assembly 20 is stationary in nature and includes a cathode focusing cup 34 positioned in a spaced relationship to the anode assembly 18 with respect to a focal track 30 for focusing electrons to a focal spot 35 on the focal track 30. A cathode filament 36 (shown in phantom) mounted to the cathode focusing cup 34 is energized to emit electrons 38 which are accelerated to the focal spot 35 to produce x-rays 40.

The anode assembly 18 includes a circular target substrate 28 having the focal track 30 along a peripheral edge of the target 28. The focal track 30 is comprised of a tungsten alloy or other suitable material capable of producing x-rays. The anode assembly 18 further includes a back plate 32 made of graphite to aid in cooling the target 28, as is known in the art. A plurality of heat pipes 33 extend from the substrate 28 into the back plate 32. The heat pipes 33 are located circumferentially spaced from one another within the substrate 28 under the focal track 30. The number of heat pipes 33 may vary depending on the desired amount of heat to be transported from the region of the focal track 30 into the back plate 32.

The anode assembly 18 is mounted to a rotor stem 22 using securing nut 24 and is rotated about an axis of rotation 26 during operation. The rotor stem 22 is connected to a rotor body 42 which is rotated about the axis 26 by an electrical stator (not shown). The rotor body 42 houses a bearing assembly 44 which provides support thereto. The bearing assembly 44 includes a bearing housing 46, ball bearings 48*a*, 48*b*, and a bearing shaft 50. The bearing shaft 50 is coupled to the rotor body 42 and rotatably supports the anode assembly 18. The bearing shaft 50 also defines a pair of inner races 52*a*, 52*b*, which provide for inner race rotation of the bearings 48*a*, 48*b*, respectively. Corresponding outer races 54*a*, 54*b* are defined in the stationary bearing housing 46. Each bearing 48*a*, 48*b*, is comprised of multiple metal balls which surround the bearing shaft 50. In the present embodiment, the metal balls are made of high speed steel, each coated with a lead or silver lubricant to provide for reduced frictional contact.

During the production of x-rays, heat is produced by virtue of the electron beam 38 impinging on the focal spot 35 of the anode assembly 18. A portion of such heat is then conducted to the back plate 32 from which it radiates in order to cool the anode assembly 18. However, present conductive heat transfer from the focal track 30 through the target substrate 28 to the back plate 32 is somewhat inefficient and limits the operating performance of the x-ray tube. Transferring heat more effectively from the focal track 30 and substrate 28 to the back plate 32 reduces the temperature of the focal track 30 during operation and allows increased x-ray tube operating performance.

Figure 2:
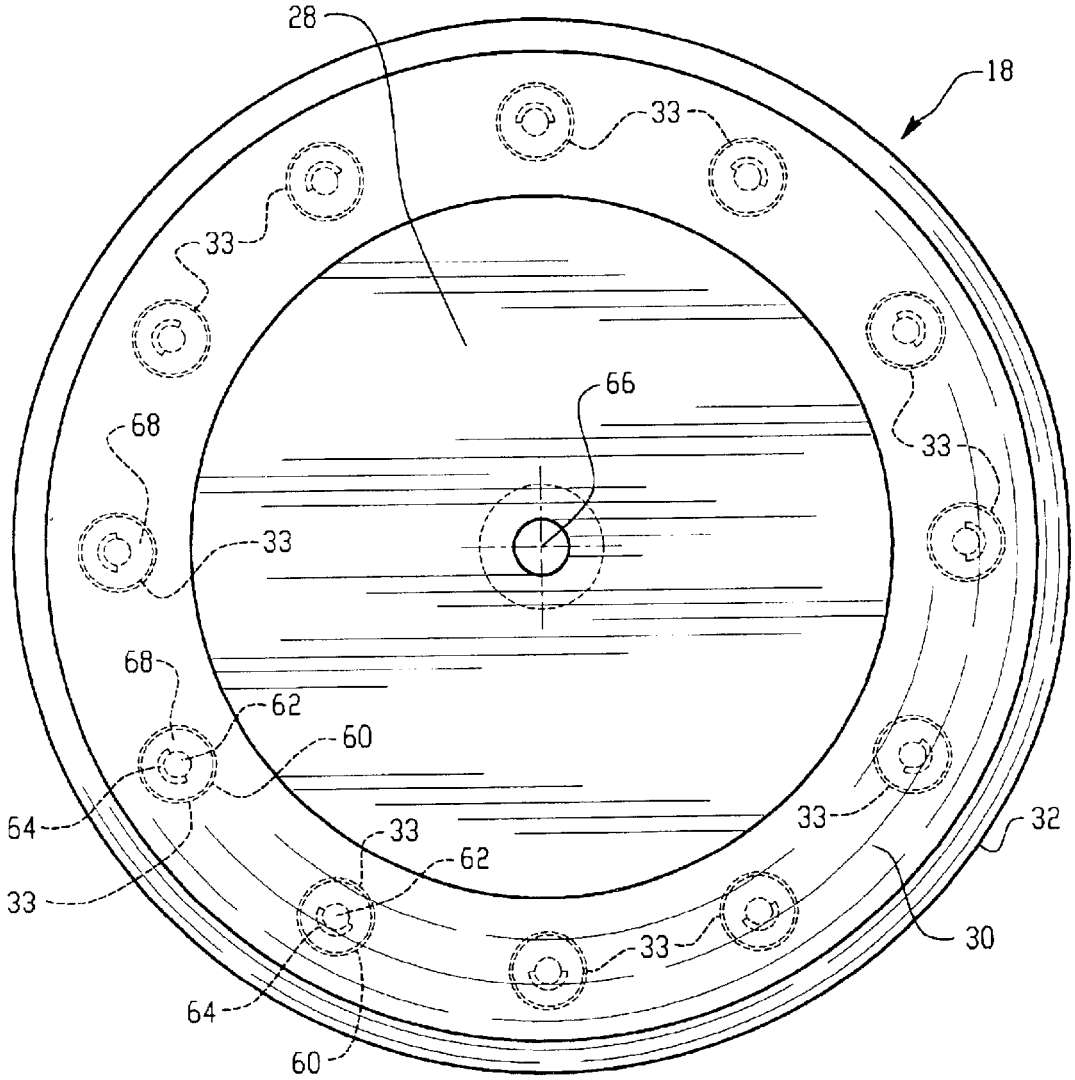
FIG. 2 is top view of an anode assembly showing aspects of the present invention.
Figure 3:
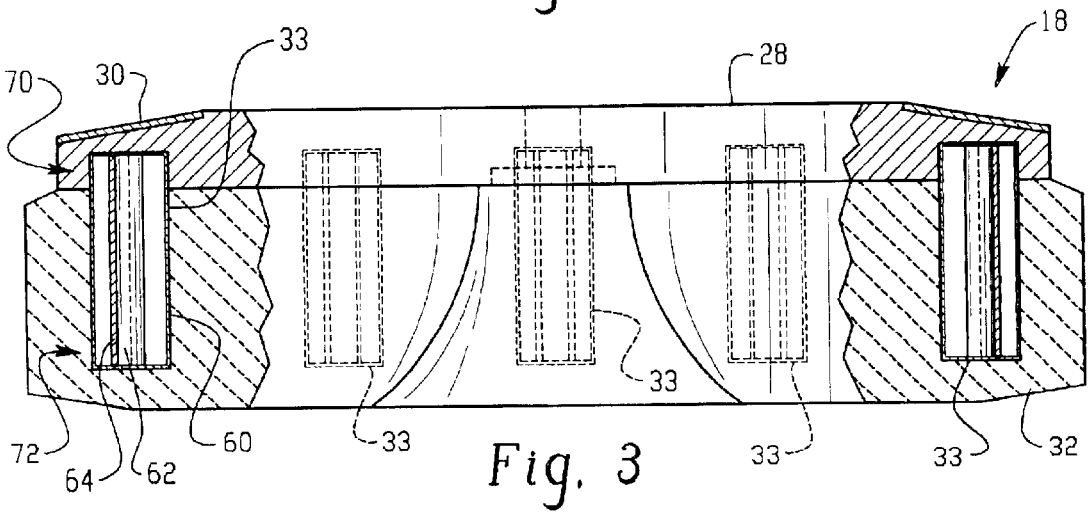
FIG. 3 is a sectional side view of the anode assembly of FIG. 2.

FIGS. 2 & 3 show an anode assembly 18 illustrating features of the present invention. The anode assembly 18 includes a plurality of liquid metal heat pipes 33 distributed circumferentially from one another around the perimeter of the anode substrate 28. The location of the heat pipes 33 is under the region of the focal track 30. The heat pipes 33 extend longitudinally having one end located in the target substrate 28 and the other end located in the graphite back plate 32. The contact between the heat pipes 33 and the target components is intimate and is accomplished by brazing or diffusion bonding the heat pipes into the target components. The number and placement of the heat pipes 33 in the target 18 may be varied depending on the desired heat transfer from the target substrate 28 to the back plate 32.

Figure 4:
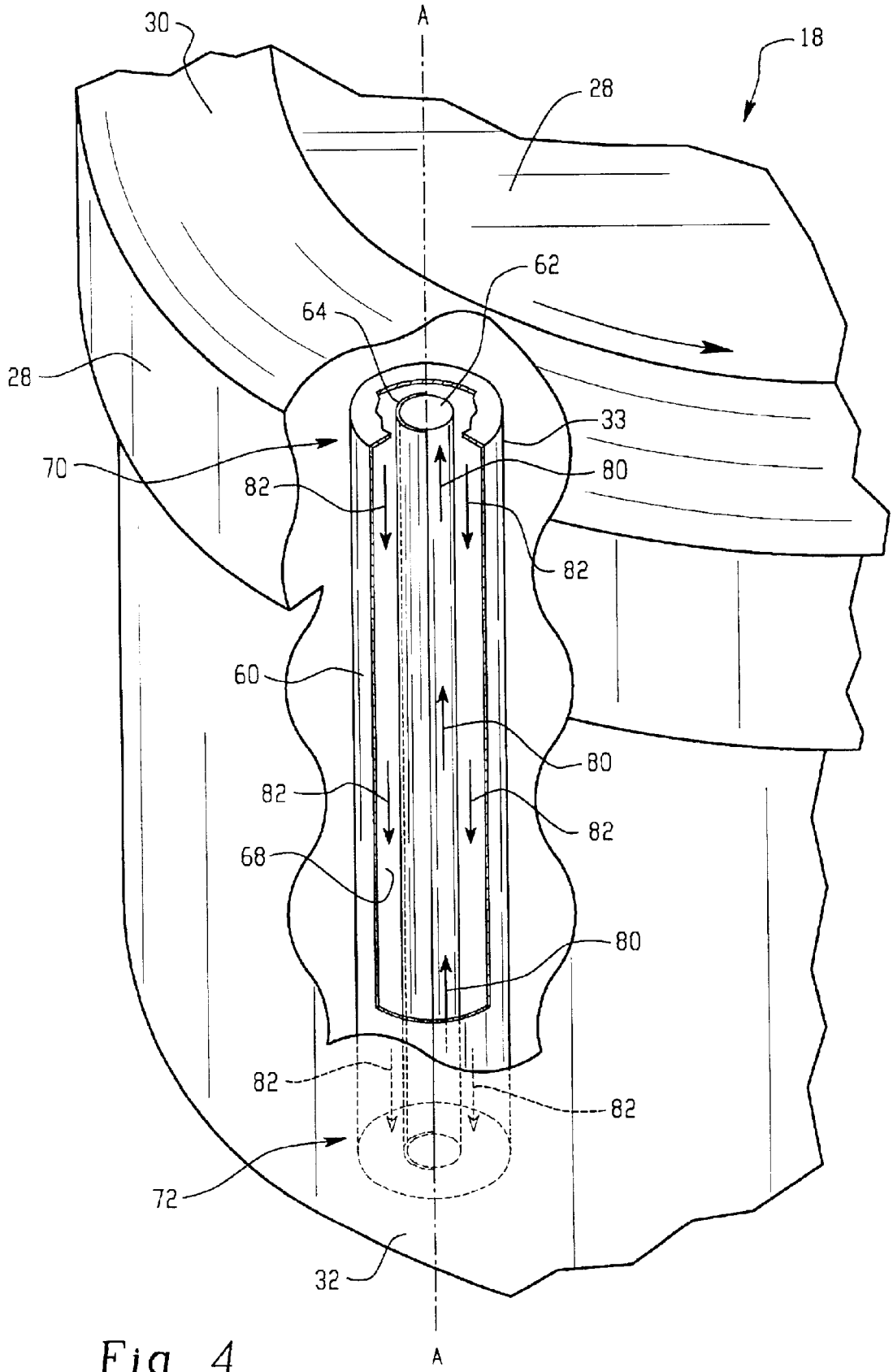
FIG. 4 is a partial sectional view of a heat pipe illustrating features of the present invention in a rotating anode assembly.

Referring to FIG. 4, the liquid metal heat pipes 33 includes an evacuated metal cylindrical pipe shell 60 sealed at each end. The heat pipe 33 is partially filled with a working fluid, a liquid metal at x-ray tube operating conditions and temperatures. Examples of suitable metals for working fluids at operating temperature comprise Sodium, Lithium, Zinc, Cadmium, Antimony as well as other similar metals having low melting temperature and moderate boiling temperature. When the heat pipe and x-ray tube are not at operating temperature, the metal used for the working fluid may be in a solid state. A cylindrical capillary wick structure 62 lies along a generally central longitudinal axis A—A of the cylindrical pipe shell 60. The wick 62 is a homogeneous screen structure and has a smaller diameter than the diameter of the shell 60. A tubular void 68 surrounds the wick 62 and is located between the wick and shell 60. A semi-circular half pipe shield 64 is attached to the wick 62 with the shield's concave opening facing the rotational center 66 of the anode assembly 18.

The heat pipe 33 extends longitudinally from an evaporator end 70 to a condenser end 72 where the working fluid collects. The capillary wick structure 62 allows the heat pipe 33 to operate by transferring the liquid working fluid, as represented by the arrows 80, to the evaporator end 70 of heat pipe 33. When the working fluid 80 reaches the evaporator end 70, it is vaporized by heat produced in the generation of x-rays. The vaporized working fluid creates a vapor pressure gradient in the heat pipe 33. Driven by the vapor pressure gradient, the vapor flows toward the condenser end 72, as represented by arrows 82, and releases heat upon condensation into the graphite back plate 32. The vapor 82 condenses and becomes liquid as it releases its latent heat of vaporization to the heat sink. The cycle continues as the working fluid returns to the evaporator end 70 through the porous wick 62 by capillary force. The centrifugal force in the rotating anode acts to push the working fluid from the wick before it can migrate to the evaporator end of the heat pipe. The shield 64 reduces working fluid loss from the porous capillary wick 62 in the radial direction during x-ray tube operation due to rotation of the anode assembly 18.

The shell 60, wick 62 and shield 64 are comprised of Molybdenum or similar heat and corrosion resistant material to withstand the high temperatures within x-ray targets. Arc-casting Molybdenum with less oxygen composition can be used to prevent corrosion. More specifically, the Molybdenum alloy may be a vacuum melted alloy with a composition of about 0.5% Ti and 0.08% Zr. This composition has less residual oxygen to react with the liquid metal working fluids than standard powder metallurgy grade molybdenum. The shield 64 may alternatively be formed of a suitable foil.

In general, the cooling effect of the heat pipe 33 conducts heat away from a source of heat such as the focal track 30 of the target 28. In one simulated profile of contours of static temperature of a 90 Kw anode during operation, the focal track temperature was 1450° K. with heat pipes located under the focal track and 2070° K. without the heat pipes. Thus, the heat capacity of the target is increased and more power is available from a physically smaller target. Higher scanning power enables faster scans or thinner slices on a CT scanner. This design allows for more scanning in a given period of time with smaller targets.

Figure 5:
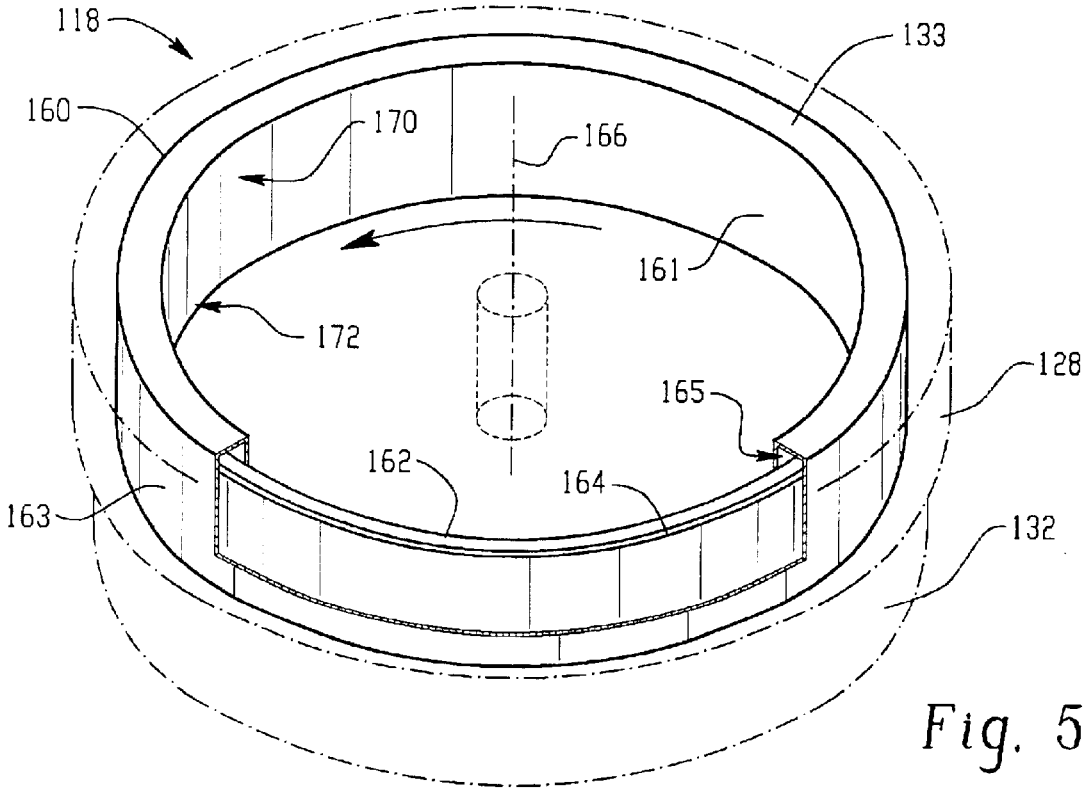
FIG. 5 is a perspective partial sectional view of another anode assembly having a heat pipe illustrating features of the present invention.

Turning to FIG. 5, another structure for an anode assembly 118 with a heat pipe 133 is shown illustrating aspects of the present invention. Materials for the components of the heat pipe 133 and principles of operation are similar to those described above. The target includes a substrate 128, generally central anode axis 166 and a back plate 132 are shown in phantom. The heat pipe 133 is comprised of a shell 160, a wick 162, a shield 164 and liquid metal working fluid.

The shell 160 includes two concentric generally parallel tubular walls, an inner wall 161 and an outer wall 163. Each of the generally tubular walls 161, 163 extend longitudinally along the axis 166. A generally tubular void 165 exists between the walls 161, 163. The shell 160 is sealed at each end and is evacuated. The wick 162 is generally tubular and is received within the void 165 of the shell 160. The wick 162 is surrounded by the void 165 and spaced approximately equidistant from each of the walls 161, 163. The shield 164 is located on the surface of the wick 162 nearest the outer wall 163. At operating temperature, the liquid metal working fluid (not shown) resides in the evacuated 165 with the wick 162. As described above, the shield 164 reduces the loss of working fluid from the porous wick 162 during rotation of the anode 118 around its center 166.

The heat pipe 133 extends from an evaporator end 170 located in the target substrate 128 to a condenser end 172 located in the graphite back plate 132 where the working fluid collects. The capillary wick structure 162 allows the heat pipe 133 to operate by transferring the liquid working fluid to the evaporator end 170 of heat pipe 133 where it is vaporized by heat produced in the generation of x-rays. The vaporized working fluid creates a vapor pressure gradient in the heat pipe 133. Driven by the vapor pressure gradient, the vapor flows toward the condenser end 172 and releases heat upon condensation into the graphite back plate 132. The vapor condenses upon losing its heat and becomes liquid as the vapor releases its latent heat of vaporization to the heat sink. The cycle continues as the working fluid returns to the evaporator end 170 through the porous wick 162 by capillary force.

Figure 6:
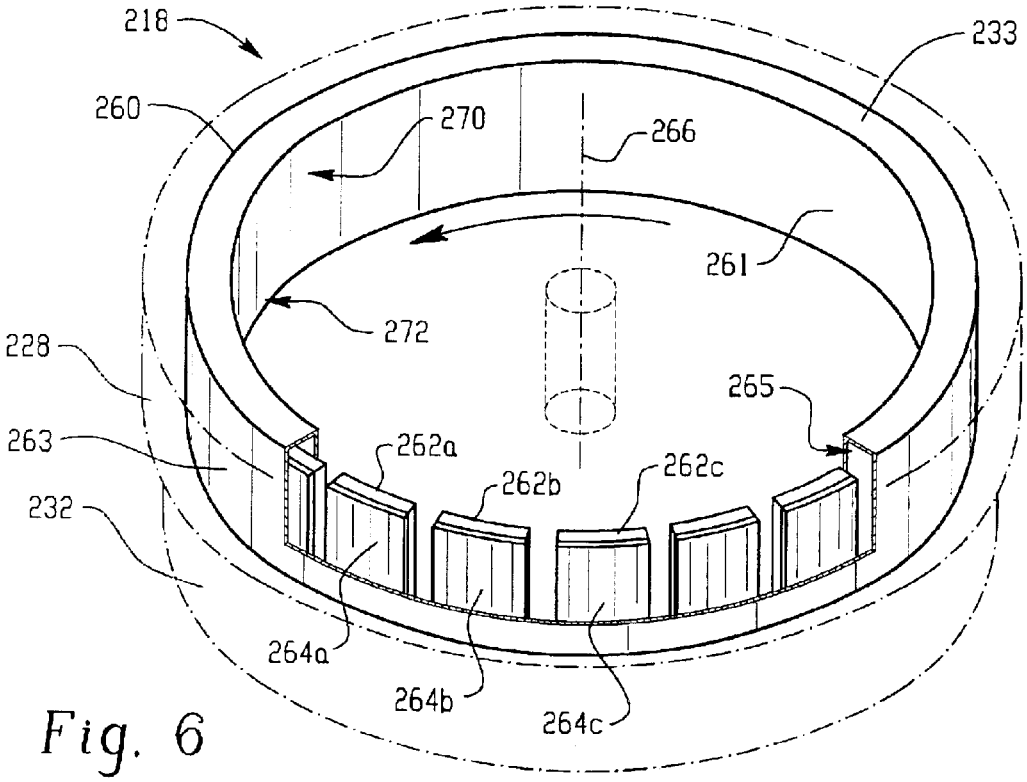
FIG. 6 is a perspective partial sectional view of another anode assembly having a heat pipe illustrating features of the present invention.

In FIG. 6, another structure for an anode assembly 218 with a heat pipe 233 is shown illustrating aspects of the present invention. Materials for the components of the heat pipe 233 and principles of operation are similar to those described above. The target includes a substrate 228, a generally central axis 266 and back plate 232 are shown in phantom. The heat pipe 233 is comprised of a shell 260, a plurality of wicks 262*a, b, c . . . n*, a plurality of shields 264*a, b, c, . . . n* for associated wicks 262*a–n* and liquid metal working fluid.

The shell 260 includes two concentric generally parallel tubular walls, an inner wall 261 and an outer wall 263, each of which extend longitudinally along the generally central axis 266. A generally tubular void 265 exists between the walls 261, 263. The shell 260 is sealed at each end and is evacuated. The plurality of wicks 262*a–n* are rectangular in shape and can be concave. The wicks 262*a–n* are received within the void 265 of the shell 260. The wicks 262*a–n* are spaced circumferentially from one another around the heat pipe 233. The number of wicks 262*a–n* can be varied as well as the dimensions of each respective wick. The wicks 262*a–n* are generally surrounded by the void 265 and spaced approximately equidistant from each of the walls 261, 263. The shields 264*a–n* are located on the surface of their respective wick 262*a–n* nearest the outer wall 263. At operating temperature, the liquid metal working fluid resides in the evacuated void 265 with the wicks 262*a–n*. As described above, the shields 264*a–n* reduce the loss of working fluid (not shown) from the porous wicks 262*a–n* during rotation of the anode 218 around its center 266.

The heat pipe 233 extends from an evaporator end 270 located in the target substrate 228 to a condenser end 272 located in the graphite back plate 232 where the working fluid collects. The capillary wick structures 262*a–n* allows the heat pipe 233 to operate by transferring the liquid working fluid to the evaporator end 270 of heat pipe 233 where it is vaporized by heat produced in the generation of x-rays. The vaporized working fluid creates a vapor pressure gradient in the heat pipe 233. Driven by the vapor pressure gradient, the vapor flows toward the condenser end 272 and releases heat upon condensation into the graphite back plate 232. The vapor condenses upon losing its heat and becomes liquid as the vapor releases its latent heat of vaporization to the heat sink. The cycle continues as the working fluid returns to the evaporator end 270 through the porous wicks 262*a–n* by capillary force.

Heat pipes have the ability to dissipate very high heat fluxes and heat loads through small cross sectional areas. Heat pipes have a very large effective thermal conductivity and can move a large amount of heat from source to sink. A typical heat pipe can have an effective thermal conductivity substantially larger than a similar solid copper conductor. Advantageously, heat pipes are totally passive and are used to transfer heat from a heat source to a heat sink with minimal temperature gradients, or to isothermalized surfaces.

While a particular feature of the invention may have been described above with respect to only one of the illustrated embodiments, such features may be combined with one or more other features of other embodiments, as may be desired and advantageous for any given particular application.

From the above description of the invention, those skilled in the art will perceive improvements, changes and modification. Such improvements, changes and modification within the skill of the art are intended to be covered by the appended claims.

Having described a preferred embodiment of the invention, the following is claimed:

1. An x-ray tube comprising:

an evacuated envelope;

a cathode assembly located in the evacuated envelope;

a disk shaped anode assembly located in the evacuated envelope in operative relationship with the cathode assembly for generating x-rays, the anode assembly including an axis of rotation and a target substrate facing the cathode assembly for generating the x-rays; and a heat pipe located within the anode assembly, the heat pipe comprising:

an evacuated shell having a first tubular wall and a second tubular wall concentrically spaced apart from one another and defining a void, each of the first and second tubular walls having a central longitudinal axis that lies generally along the axis of rotation of the anode assembly, the tubular walls vacuum sealed at a first end of the shell and at a second end of the shell;

a material within the shell that is a working fluid for the heat pipe at x-ray tube operating conditions;

a porous wick located within the void of the shell and radially spaced from the shell, the wick having a height extending from the first end of the shell to the second end of the shell; and a shield attached to a surface of the wick and extending along the height of the wick.

2. The x-ray tube of claim 1 wherein the anode assembly includes a back plate attached to the target substrate located opposite the cathode assembly.

3. The x-ray tube of claim 2 wherein the first end of the heat pipe is located in the target substrate and the second end is located in the back plate.

4. The x-ray tube of claim 1 wherein the target substrate includes an annular focal track near the perimeter of the target substrate and the heat pipe is located approximately under the focal track.

5. The x-ray tube of claim 1 wherein the shield is located on the wick on a surface of the wick facing away from the axis of rotation of the anode assembly.

6. The x-ray tube of claim 1 wherein the shell, the wick and shield are comprised of vacuum melted arc-cast Molybdenum alloy.

7. The x-ray tube of claim 1 wherein the Molybdenum alloy includes about 0.5% Ti and 0.08% Zr.

8. The x-ray tube of claim 1 wherein the wick is a tubular wall located within the void between the first and second walls of the shell.

9. An x-ray tube comprising:

an evacuated envelope;

a cathode assembly located in the evacuated envelope;

an anode assembly located in the evacuated envelope in operative relationship with the cathode assembly for generating x-rays, the anode assembly including, an axis of rotation, a target substrate facing the cathode assembly for generating the x-rays and a back plate located opposite the cathode assembly, and at least one heat pipe located within the anode assembly, the heat pipe comprising:

a longitudinal cylindrical evacuated shell having a generally central longitudinal axis, a first end of the shell located in the target substrate and a second end located in the back plate, and at least one side wall extends between the first and second ends;

a material within the shell that is a working fluid for the heat pipe at x-ray tube operating conditions;

a porous cylindrical wick within the shell and generally extending along the longitudinal axis from the first end of the shell to the second end of the shell;

a tubular void within the shell that extends along the wick between the wick and shell; and a shield within the shell and attached to the wick along its length, the shield being spaced from the shell side wall.

10. The x-ray tube of claim 9 wherein the shell, the wick and shield are comprised of vacuum melted arc-cast Molybdenum alloy.

11. The x-ray tube of claim 10 wherein the Molybdenum alloy includes about 0.5% Ti and 0.08% Zr.

12. The x-ray tube of claim 9 wherein the target substrate includes an annular focal track near the perimeter of the target substrate and a plurality of heat pipes are located under the focal track the heat pipes spaced circumferentially from one another around the target substrate.

13. An x-ray tube comprising:

an evacuated envelope;

a cathode assembly located in the evacuated envelope;

an anode assembly mounted in the evacuated envelope for rotation about an axis of rotation and in operative relationship with the cathode assembly for generating x-rays, the anode assembly including a target substrate facing the cathode assembly for generating the x-rays and a back plate located opposite the cathode assembly, and at least one heat pipe located within the anode assembly, the heat pipe including:

a cylindrical evacuated shell having a generally central longitudinal axis, a first end of the shell located in the target substrate and a second end located in the back plate;

a material within the shell that is a working fluid for the heat pipe at x-ray tube operating conditions;

a porous cylindrical wick within the shell and generally extending along the longitudinal axis from the first end of the shell to the second end of the shell;

a tubular void within the shell that extends along the wick between the wick and shell; and a shield attached to the wick alone its length, the shield defining a half pipe with its concave surface facing the axis of rotation of the anode assembly.

14. The x-ray tube of claim 13 wherein the shield reduces working fluid loss out of the wick into the tubular void between the first and second end during x-ray tube operation.

15. An x-ray tube comprising:

an evacuated envelope;

a cathode assembly located in the evacuated envelope;

a disk shaped anode assembly located in the evacuated envelope in operative relationship with the cathode assembly for generating x-rays, the anode assembly including an axis of rotation and a target substrate facing the cathode assembly for generating the x-rays; and a heat pipe located within the anode assembly, the heat pipe comprising:

an evacuated shell having a first tubular wall and a second tubular wall concentrically spaced apart from one another and defining a void, each of the first and second tubular walls having a central longitudinal axis that lies generally along the axis of rotation of the anode assembly, the tubular walls vacuum sealed at a first end of the shell and at a second end of the shell;

a working fluid contained in the shell;

a tubular porous wick located within the void of the shell, the wick having a height extending from the first end of the shell to the second end of the shell, the wick having at least one gap separating adjacent surfaces of wick material; and a shield attached to and extending along the height of the wick.

16. The x-ray tube of claim 15 wherein the wick is comprised of a plurality of wick segments separated by the gaps.

17. An x-ray tube comprising: an evacuated envelope; a cathode assembly located in the evacuated envelope;

a disk shaped anode assembly located in the evacuated envelope in operative relationship with the cathode assembly for generating x-rays, the anode assembly including, an axis of rotation and a target substrate facing the cathode assembly for generating the x-rays; and a plurality of heat pipes located within the anode assembly and angularly spaced around the axis of rotation, each of the heat pipes comprising:

an evacuated shell vacuum sealed at a first end of the shell and at a second end of the shell;

a material within the shell that is a working fluid for the heat pipe at x-ray tube operating conditions;

a porous wick located within the shell, the wick having a length extending from the first end of the shell to the second end of the shell; and means intermediate the wick and the shell for reducing working fluid loss out of the wick during x-ray tube operation.

18. The x-ray tube of claim 17 wherein the means for reducing working fluid loss includes a shield attached to the wick.

19. An x-ray tube comprising:

an evacuated envelope;

a cathode assembly located in the evacuated envelope;

a disk shaped anode assembly located in the evacuated envelope in operative relationship with the cathode assembly for generating x-rays, the anode assembly including an axis of rotation and a target substrate facing the cathode assembly for generating the x-rays; and a heat pipe located within the anode assembly, the heat pipe comprising:

an evacuated shell having a first tubular wall and a second tubular wall concentrically spaced apart from one another and defining a void, the tubular walls vacuum sealed at a first end of the shell and at a second end of the shell;

a working fluid for the heat pipe at x-ray tube operating conditions contained in the shell; and a porous wick located within the void of the shell, the wick having a height extending from the first end of the shell to the second end of the shell;

a shield attached to and extending along the height of the wick, the shield reducing working fluid loss out of the wick between the first and second ends into the void duing x-ray tube operation.

20. An x-ray tube comprising:

an evacuated envelope;

a cathode assembly located in the evacuated envelope;

a disk shaped anode assembly located in the evacuated envelope in overative relationship with the cathode assembly for generating x-rays, the anode assembly including an axis of rotation and a target substrate facing the cathode assembly for generating the x-rays; and a heat pipe located within the anode assembly, the heat pipe comprising:

an evacuated shell having a first tubular wall and a second tubular wall concentrically spaced apart from one another and defining a void, each of the first and second tubular walls having a central longitudinal axis that lies generally along the axis of rotation of the anode assembly, the tubular walls vacuum sealed at a first end of the shell and at a second end of the shell;

a material within the shell that is a working fluid for the heat pipe at x-ray tube operating conditions;

a porous wick located within the void of the shell, the porous wick comprising a plurality of wick segments, each wick segment spaced circumferentially apart from one another within the void, the wick having a height extending from the first end of the shell to the second end of the shell; and a shield attached to and extending along the height of the wick.

* * * * *